US005946818A

United States Patent [19]

Baxter et al.

[11] Patent Number: 5,946,818

[45] Date of Patent: Sep. 7, 1999

[54] PROCESS AND APPARATUS FOR DRYING LIQUID-BORNE SOLID MATERIAL

[75] Inventors: Hamish Baxter, Co Clare, Ireland; Andrew Nicolson Carruthers, Beaconsfield, Canada; Hans-Peter Elkjaer, Borkop, Denmark; Bryan Hiscox, Ste Madeleine de Rigaud, Canada; Jens Fenger, Valby; Benny E. Raahauge, Naestved, both of Denmark; Jose Gil Fernandez Pulpeiro, Foz, Spain

[73] Assignee: Alcan International Limited, Montreal, Canada

[21] Appl. No.: 08/652,578

[22] PCT Filed: Nov. 25, 1994

[86] PCT No.: PCT/GB94/02594

§ 371 Date: Sep. 23, 1996

§ 102(e) Date: Sep. 23, 1996

[87] PCT Pub. No.: WO95/15470

PCT Pub. Date: Jun. 8, 1995

[30] Foreign Application Priority Data

Nov. 30, 1993 [EP] European Pat. Off. ..... 93309520

[51] Int. Cl.[6] ..... F26B 7/00

[52] U.S. Cl. ..... 34/379; 34/169; 423/215; 423/625

[58] Field of Search ..... 34/165, 167, 168, 34/169, 187, 371, 372, 373, 377, 378, 379; 423/215, 625

[56] References Cited

U.S. PATENT DOCUMENTS

| | | | |
|---|---|---|---|
| 2,054,441 | 9/1936 | Peebles | 177/240 |
| 2,808,213 | 10/1957 | Morrison | 241/40 |
| 3,110,626 | 11/1963 | Larson et al. | 118/303 |
| 3,537,188 | 11/1970 | Harris | 34/592 |
| 4,224,288 | 9/1980 | Potter | 423/123 |
| 4,335,676 | 6/1982 | Debayeux et al. | 118/303 |
| 4,761,893 | 8/1988 | Glorioso | 34/379 |

FOREIGN PATENT DOCUMENTS

| | | |
|---|---|---|
| 1540293 | 9/1968 | European Pat. Off. . |
| 0137599 | 4/1985 | European Pat. Off. . |
| 1037374 | 8/1958 | Germany . |
| 2750449 | 5/1979 | Germany . |
| 1961 | 4/1959 | Japan . |

*Primary Examiner*—Henry Bennett
*Assistant Examiner*—Pamela A. Wilson
*Attorney, Agent, or Firm*—Stoel Rives LLP

[57] ABSTRACT

A method and apparatus are disclosed for continuously drying, preferably with agglomeration and/or coating and sizing, and separating a solid product from a liquid feed material, especially bauxite slurry which passes through a very sticky phase during drying, without significant encrustation of the equipment used. The method comprises: spraying a liquid bearing solid material upwardly into a drying zone, feeding a drying gas into the drying zone from below The spraying liquid in substantially parallel flow, removing the mixture of the drying gas and entrained dried particles from the drying zone, separating the entrained dried particles from their mixture with the drying gas, returning the separated dried particles to the drying zone, and collecting the dried particles, characterized by arranging for the formation of a slower moving boundary layer within the feeding of the drying gas, through which boundary layer dried particles are allowed lo fall under gravity to be collected, and by collecting the dried particles continuously from below the spraying liquid.

28 Claims, 2 Drawing Sheets

PROCESS AND APPARATUS FOR DRYING LIQUID-BORNE SOLID MATERIAL

Figure 1:
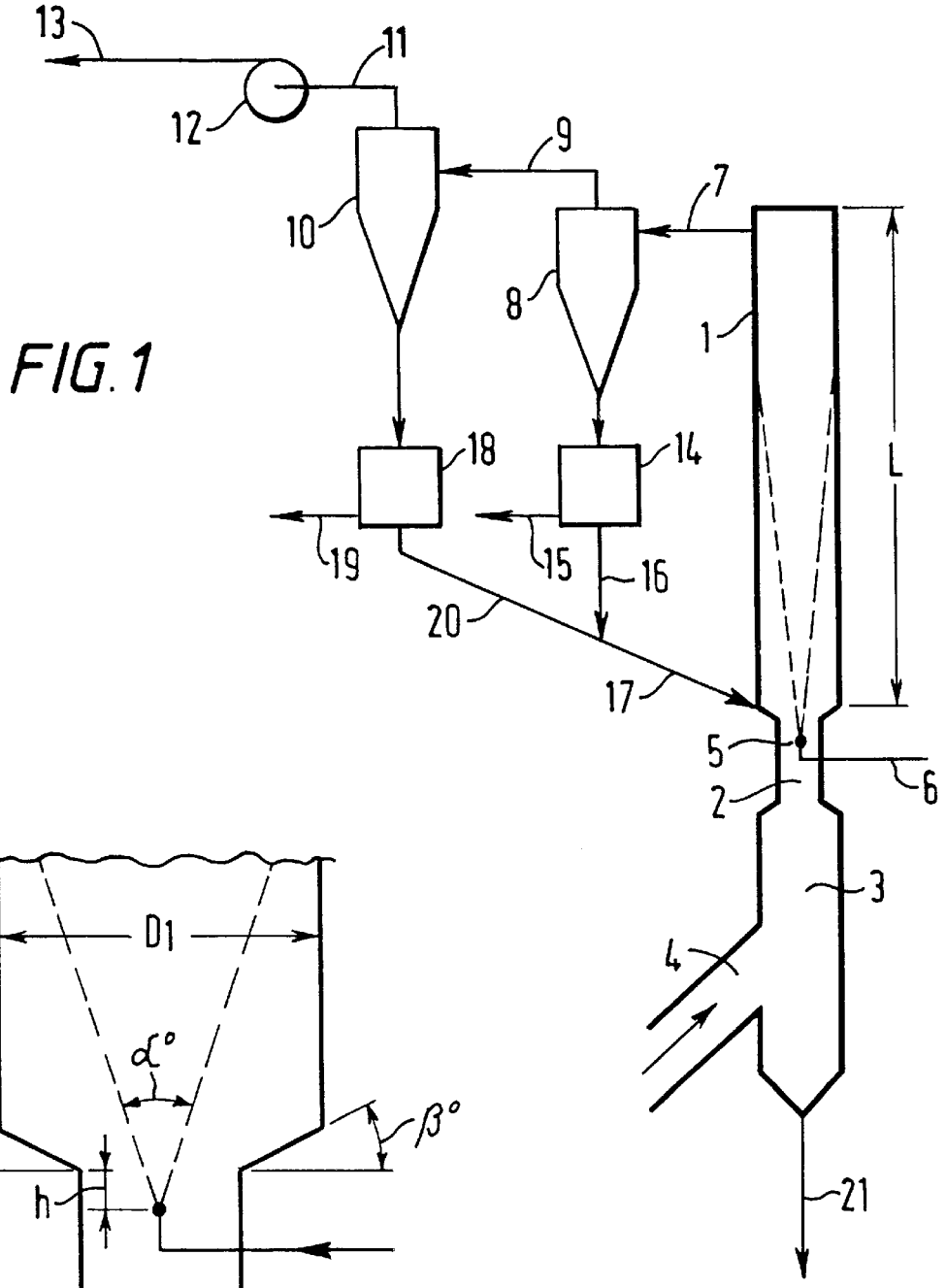

This application is the national stage of International Application No. PCT/GB94/02594, filed Nov. 11, 1994.

The present invention relates to a process and apparatus for drying solid material borne in a liquid, and particularly to a process and to an apparatus for continuously drying, preferably with agglomerating and sizing, and separating a solid product from a potentially sticky liquid feed material, optionally with a heat treatment, especially without encrustation of the equipment used.

One particularly preferred application of the present invention is in the treatment of slurries of bauxite in Bayer process liquor, and slurries of Bayer process salt cake, which are obtained by evaporating Bayer process liquors to a high concentration of caustic, thereby causing the precipitation of the sodium salts of the organic impurities and of sodium carbonate present in these liquors. The present invention is capable of converting such viscous liquids or slurries into dry, free-flowing, non-sticky, abrasion and attrition resistant particles of mainly carbonates or oxides of the metallic elements originally present in the starting material.

When solutions, slurries or moist solids are dried the material frequently passes through a sticky phase as the moisture content is reduced. This is particularly true if the liquid phase contains dissolved solids.

The standard approach to the problems this creates is to back-mix some of the dried product with the fresh feed so that the mixture passes through the sticky phase before the moisture content of the fresh feed is reduced. This technique may suffer from the disadvantages of high solids recirculation rates, high mixer power consumption, encrustation and wear of the equipment, etc.

We have now discovered a relatively simple apparatus and process for drying liquid-borne solid materials, particularly sticky moist solids, which largely avoids the difficulties mentioned above. The described apparatus and process are not limited to aqueous solutions, suspensions and slurries, but may be applied to any system in which a carrier liquid, such as a solvent, is at least partly removed from a liquid-borne solid material, such as a solution, and particularly those which pass through a transient sticky phase as the carrier liquid is progressively removed. However, in order to simplify the following description of the present invention the terms "drying", "moisture", etc. will be used, taking an aqueous slurry containing solid particles as an illustrative, but non-limiting example. In a particularly preferred embodiment the dried solid material is also agglomerated, classified and heat treated during the drying process.

The present invention is based on the principle of feeding upwardly into a rising gas stream a liquid which carries solid material, and incorporates a solids reactor design derived from a known "Gas Suspension Dryer", in which the reacted material is allowed to fall counter-currently past the feed inlet point.

Debayeux et al in U.S. Pat. No. 4,335,676 disclose the basic principles of spouted bed drying. Importantly it is disclosed that the dried product is withdrawn from the top of the bed, which is different from the present invention, where the product is collected after falling counter-current through the stream of rising heat carrier.

In DK-A-5888/83 there is disclosed a so-called "Gas Suspension Dryer" for removing pollutants such as $SO_2$ and other acid gases from flue or combustion gases in which the gases are absorbed on, and reacted with, the absorption agent in the presence of water to make a dry powder and a cleaned gas. It comprises a tubular reaction chamber with an annular bottom wall, and inlet ducts for the gas, the absorption agent, and an outlet at the top for the scrubbed gas. It is taught that the disclosed method is characterised by subjecting an axially-introduced rising stream of hot flue gas to a rapid reduction in velocity so as to cause a boundary layer separation in the lower part of the reaction zone. The method is also characterised by dispersing and suspending the absorption agent, the water and the powder in a rising stream of hot flue gas at the lower part of the reaction zone, and removing the resulting dry powder from the upper part of the reaction zone. However, here the solid products are exclusively collected in the separation section of the apparatus, which comprise cyclones, and there is no teaching that the solid materials fall through the throat or inlet duct as in the present invention. Furthermore, the suspension of absorbent particles is blown into the annular bottom through the same feeding duct, preferentially provided with a venturi injection nozzle in the side of the wall, and not, as in the present invention, by an atomizer mounted in the centre of the throat, and jetting upwards into the reaction zone.

DK-A-3646/84, which is equivalent to EP-A-137,599, discloses a variation of the method and apparatus described in DK-A-5888/83, and is distinguished in that the absorption agent is suspended in a rising swirling stream of hot flue gas at the bottom of the reaction zone and is subjected to a rapid reduction in axial velocity at the lower part of the reaction zone. This swirling is achieved by passing the gas through a swirl-inducing zone, before it is introduced axially into the reaction zone, by means of radial guides arranged in the reaction zone or by introducing a second stream of hot flue gas tangentially into the reaction zone. Again, this disclosure does not teach that the solid product particles pass through the throat of the apparatus, instead the dry solids are collected in the gas/solid separators, viz. cyclones.

Bildjukevich et al in U.S. Pat. No. 4,421,594 disclose a granulation device and process which comprises spraying a liquid suspension into a reaction zone, supplying a flow of heating fluid to suspend the spray and simultaneously to deliver fine fractions of the dried material to the spraying zone, wherein the step of drying the suspension is conducted in both a co-current and a counter-current fashion. However, the heat carrier is supplied in the form of a spiral flow, which is also necessary to separate the fine fractions from the dried material and to return them to the spraying zone, as well as to classify the product according to size. This spiral flow is obtained by arranging that the heat carrier introducing means is mounted in the lower portion of the chamber and is arranged in spirals, the pitch and diameter of the spiral turns being variable along the length of the chamber and increasing towards the mounting site of the suspension drying means so as to provide in the chamber upcoming spiral flows of the heat carrier. In distinction, with the present process and apparatus it has surprisingly been found that, not only it is not necessary to provide a spiral twisting flow of high velocity gas in order to obtain the desired drying and sizing of the agglomerates, but much larger agglomerates—4 mm and larger—can be produced than is possible with the described process and apparatus of Bildjukevich et al. Who report that their product is only from at least 200 microns to at most 800 microns.

Itoh et al in U.S. Pat. No. 5,044,093 disclose a granulation apparatus in which there is fluidizing granulation, agitating granulation and spouted bed granulation. It is disclosed that the apparatus shown in FIG. 2 comprises a cylindrical portion and conical portion, and that the liquid to be processed can be atomised by means of a pressure nozzle, but that, in addition, an agitating means is required consisting of rotating agitating blades. Significant differences from the present invention are that the product is withdrawn from the agitated granulation section or bed at or above the rotating blades, and not by passing the product through the flow of hot gases; and that the hot drying gases are introduced at the top of the drying section.

Kinno et al in U.S. Pat. No. 4,353,730 disclose aspects of granulation in spouted beds. However, there is no disclosure of removal of the product granules by making them pass through the upwards flow of heat carrier gas as in the present invention, instead it is disclosed that the product from each stage is removed by overflowing from the top of the bed of granules.

Nioh at al in U.S. Pat. No. 4,353,709 disclose a process for granulation in which both a fluidized bed and a spouted bed reactor are used. This disclosure teaches that the product material is held on top of perforated plate and consequently the product is withdrawn from the top of the fluidized/spouted bed. This does not read on the present invention, in which the product is withdrawn from the bottom of the bed by passing it counter-current to the upward flow of the heat carrier.

Thompson in U.S. Pat. No. 3,883,327 discloses a method for agglomerating alfalfa dust, which comprises leading the dust laden gas through a first venturi having a converging section, through a throat, and out through a diverging cone. After a change in direction, the gas is lead through a diverging section and a second frusto-conical converging section, followed by a second venturi, comprising another converging section, a throat, and a diverging section. It is to be noted that the first venturi section includes a first water nozzle disposed immediately ahead of the first venturi, and that a second group of water nozzles is located in the forwardmost part of the first diverging frusto-conical section. The solid particles are collected in a centrifugal separator, located at the end of the series of venturis.

The teaching of Thompson does not lead one to the present invention because:

- in the present invention the atomizer, the only point for infecting the solution, is located inside the throat of the device, before the diverging cone, in distinction with the teaching of Thompson, who not only locates a first nozzle in the throat section before the converging section, but also locates a second group of nozzles in the forwardmost section of the second diverging frusto-conical section.
- in the present invention the solids are recovered from the layer located at the bottom of the first frusto-conical section of the reactor, and after passing through the throat of the device, in which is located the atomizer, counter-current through the upward flow of gas, in distinction to Thompson, who teaches the collection of the solids in a centrifugal separator at the far end of the series of venturi.

In regard to the most preferred application of the present invention, i.e. the treatment of slurries of bauxite suspended in Bayer process liquor, the process of converting said slurries to eliminate the carbon-containing compounds therein disclosed in the following two documents.

Yamada et al in U.S. Pat. No. 4,280,987 describe the background to the need to destroy the carbon-containing compounds and teaches the need to adjust the molar ratio of $Al_2O_3/Na_2O$ to from 1:1 to 1:5. They also describe that the oxidation of the carbon-containing compounds can be done at 500 to 1350° C. and that the heat treatment can be done in a rotary kiln or in a fluidized calciner. Although Yamada does allude to the process of evaporating and drying the solid product in Col. 8 line 19 to 22, there is no teaching about the specific type of dryer or granulator needed to handle the viscous slurry that is produced.

Yamada et al in AU-A-70264/91 are again concerned with the conversion of the salt cake obtained from Bayer process solutions. The alleged novelty in this disclosure is that the slurry is converted into granules prior to being heated in the rotary furnace, and that the granules are classified, with the coarse material being heat treated, and the fines being returned to agglomeration. Yamada dries and agglomerates the slurry, and handles the dust generated during the agglomeration and the heat treatment by collection in a cyclone and transfer to a granulating stage which uses a pug mill for rolling and compressing the product. Yamada does not disclose any other device to achieve the agglomeration, and does not teach the use of the type of drying apparatus which is the subject of the present invention.

Larson et al in U.S. Pat. No. 3,110,626 disclose an apparatus for coating discrete solid material which is similar to that disclosed in U.S. Pat. No. 4,335,676 but in which the use of a gas foil guidance element is taught in order to achieve uniform coating. Although there is mention of unwanted agglomerated material falling past the liquid feed nozzle and being collected at the bottom of the apparatus, this way of removing desired product continuously during the drying process is not taught.

In accordance with the present invention there is provided an apparatus for continuously drying solid material borne in a liquid, which apparatus is of the type described in DE-A-2 750 449 in that it comprises a drying vessel having a lower inlet for a drying gas and an upper outlet for a mixture of the drying gas and entrained dried particles of solid material, an upwardly directed spray nozzle for the liquid bearing solid material, and an outlet for the dried particles, wherein the lower portion of the drying vessel is shaped to guide descending particles of the solid material being dried by the drying gas back towards the drying gas inlet, but characterised in that the spray nozzle is positioned within the lower inlet for the drying gas but spaced from the walls thereof, and in that the apparatus further includes means for separating the entrained dried particles from their mixture with the drying gas, means for returning the separated dried particles to the drying vessel, and means for continuously removing the dried particles positioned with their outlet below the spray nozzle, and in that the drying gas inlet is arranged to supply the drying gas into the drying vessel past the spray nozzle in substantially parallel flow leaving a slower moving boundary layer adjacent the walls of the drying gas inlet through which dried particles can fall under gravity towards their outlet, when the apparatus is in use.

By the term "substantially parallel" is meant that the gas flow generally follows in line with the contours of the walls of its containing duct without any gross spiralling of the flow, although some turbulence and local eddying can take place without affecting the bulk flow.

"Continuously" also includes "substantially continuously", i.e. with relatively short breaks.

In the preferred apparatus of the present invention the drying vessel is of a sufficient diameter in relation to that of the drying gas inlet that as the drying gas enters the vessel it is subject to a rapid reduction in velocity so as to cause a boundary layer separation in the lower part of the vessel. This boundary layer separation and its advantages are described in detail in DK-A-5888/83.

Preferably the apparatus includes a single drying gas inlet wherein the interior of the lower portion of the drying vessel is frusto-conical and tapers downwardly and inwardly towards the said single drying gas inlet. The drying gas inlet can be in the form of an angled duct having in the region of the angle the dried particles outlet, which preferably includes in the region of the angle inlet gas guide means for assisting the maintenance of substantially parallel flow of the drying gas around the angle when the apparatus is in use, or the drying gas inlet can be in the form of a straight duct connecting the drying vessel to a dried particles collecting vessel having therein an inlet for the drying gas and an outlet for the dried particles.

Where the drying gas inlet to the drying vessel is in the form of a straight duct connecting the drying vessel to the dried particles collecting vessel, the upper portion of the collecting vessel is preferably frusto-conical and tapers upwardly and inwardly towards the said straight duct.

Desirably the apparatus includes at least one separated particle classification means for selecting particles of a defined particle size for return to the drying vessel.

The present invention also provides a method of continuously drying solid material borne in a liquid which method comprises:

spraying a liquid bearing solid material upwardly into a drying zone, feeding a drying gas into the drying zone from below the spraying liquid in substantially parallel flow, removing the mixture of the drying gas and entrained dried particles from the drying zone, separating the entrained dried particles from their mixture with the drying gas, returning the separated dried particles to the drying zone, and collecting the dried particles, characterised by arranging for the formation of a slower moving boundary layer within the feeding of the drying gas, through which boundary layer dried particles are allowed to fall under gravity to be collected, and by collecting the dried particles continuously from below the spraying liquid.

Preferably a circulation of drying particles is set up within the drying zone. the descending drying particles being guided towards the feeding drying gas, and desirably the method includes classifying the separated dried particles and returning to the drying zone only those of a selected particle size. It is also possible for the temperature reached by the drying particles in the drying vessel to be sufficiently high to effect chemical reaction of the particles. Thus it is within the present invention for the feed liquid to carry a solids precursor, rather than a solid material itself, such that on meeting the rising gas in the trying zone a solid material in particulate form is created by the reaction of the feed liquid and the gas.

In a first preferred embodiment the process of the present invention comprises the steps of:

converting a feed liquid bearing solid material into an aerosol mist of finely divided droplets by passing it through an atomizer located axially in an inlet gas throat below the bottom frusto-conical section of a drying vessel;

concurrently passing through said throat a flow of gas heated to between 100 and 1000° C., preferably to 400 to 800° C., preferably in substantially parallel flow;

optionally, previously massing said flow of gas through a bend in its supply duct, preferably a right angled bend fitted with curved flow straightening vanes, and then preferably through an expansion chamber prior to passing into the throat;

subjecting the combined streams of gas and aerosol to a rapid reduction in velocity by passing them into a drying vessel mounted on top of the said frusto-conical section, so as to cause a boundary separation in the bottom part of the vessel;

accumulating a layer of particles above the throat of the vessel;

passing the resulting dispersion of gas and fine particles at the top of the vessel through one or a plurality of solid/gas separators to separate the solid residue from the gas;

venting the gas to the atmosphere or recycling it to the process;

returning the fine particles to the bottom of the vessel;

passing the particles from the accumulated layer through the throat of the vessel counter-current to the upward flow of hot gas;

collecting the size-classified product in the gas supply duct below the throat of the atomizer; and removing the dried and size-classified particles continuously from the said duct, preferably from the expansion chamber.

In a second preferred embodiment which includes the agglomeration of dry particles and/or the coating of dry particles, the process comprises the steps of:

converting a feed solution or slurry of binder for the agglomeration or coating, which consists of a coating material dissolved or dispersed in a suitable liquid carrier or solvent, into an aerosol mist by passing it through an atomizer located axially in an inlet gas throat below the bottom frusto-conical section of a drying vessel;

concurrently passing through said throat a flow of gas heated to between 100 and 1000° C., preferably to 400 to 800° C., preferably in substantially parallel flow;

optionally, previously passing said flow of gas through a bend in its supply duct, preferably a right angled bend fitted with curved flow straightening vanes, and then preferably through an expansion chamber prior to passing into the throat;

subjecting the combined streams of gas and aerosol to a rapid reduction in velocity by passing them into a drying vessel mounted on top of the said frusto-conical section, so as to cause a boundary separation in the bottom part of the vessel;

simultaneously introducing the particles to be treated into the bottom of the vessel just above the frusto-conical section;

passing the dispersion of gas and fine particles at the top of the vessel through one or a plurality of solid-gas separators to separate the solid residue from the gas;

venting the gas to the atmosphere or recycling it to the process;

returning the fine particles to the bottom of the vessel;

accumulating a layer of particles above the throat of the vessel;

passing the particles through the throat of the vessel counter-current to the upward flow of hot gas;

collecting the size-classified product in the gas supply duct below the throat of the atomizer; and removing the dried, size-classified, agglomerated and/or coated particles continuously from the gas supply duct, and preferably from the expansion chamber.

In a third preferred embodiment which includes the conversion of a slurry of salt cake obtained by evaporating impure Bayer process liquor, and consisting of sodium oxalate and sodium carbonate along with the sodium salts of other carbon-containing compounds, the said process includes the steps of:

adjusting the molar ratio of $Al_2O_3/Na_2O$ of the feed slurry to between 1:1 and 1:5, by the addition of an aluminium oxide or its precursor or of bauxite prior to conversion into an aerosol mist;

drying, and preferably agglomerating, the slurry by the process of the present invention, thereby converting it into dry, free-flowing particles;

subjecting the dry particles to heat treatment at temperatures between 500 and 1350° C. in, for example, a rotary kiln, fluidized bed reactor, or shaft kiln, whereby the sodium oxalate and sodium carbonate values are converted into $Na_2O$; and treating the heated material with water or a Bayer process solution to dissolve out the soluble sodium values therein and produce a solution containing an increased concentration of NaOH.

By means of the present invention dry particles can be obtained, particularly from bauxite slurry, which have an average particle size of at least 0.5 mm, and preferably from 2 to 15 mm, which is much greater than can be achieved using the method and apparatus of U.S. Pat. No. 4,421,594.

Figure 2:
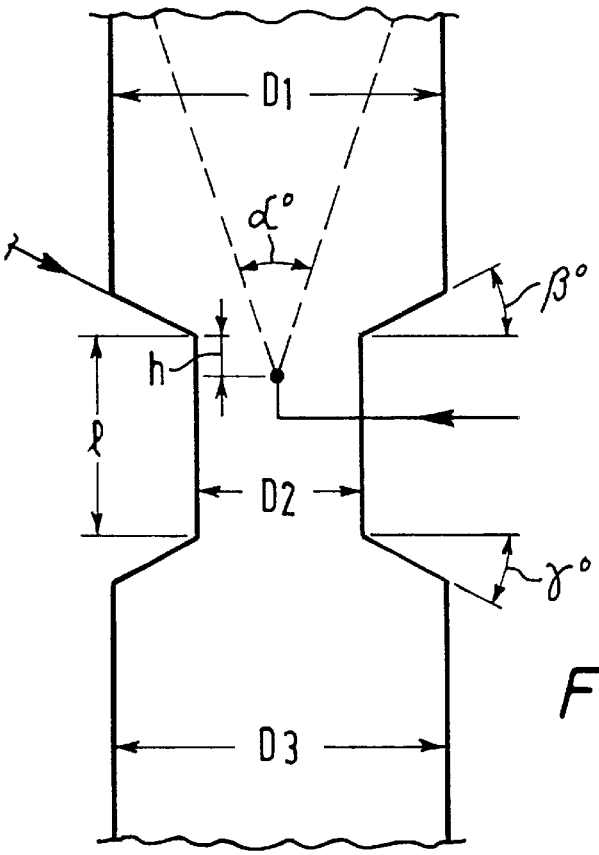
Figure 3:
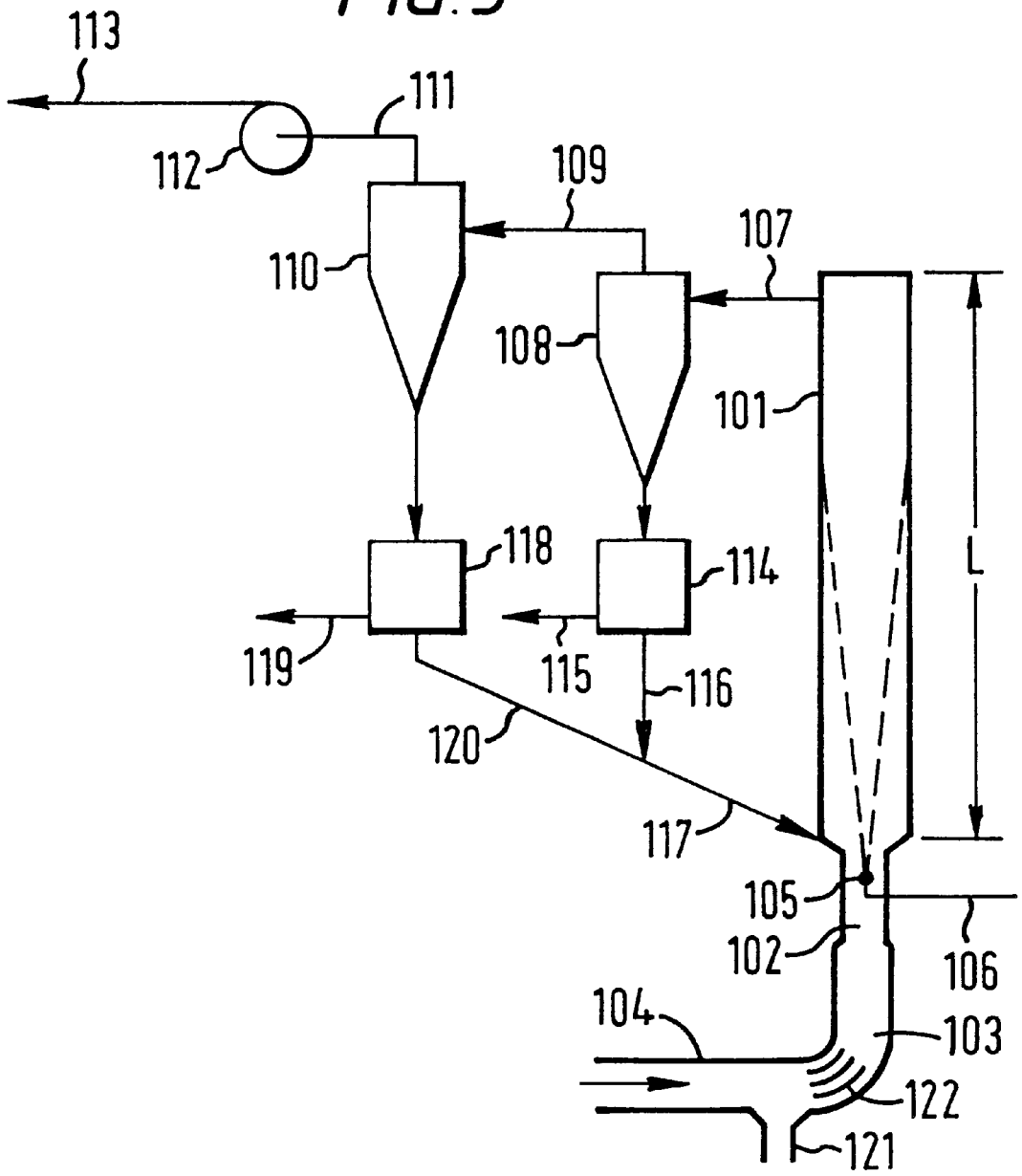

Two embodiments of the present invention will now be described with reference to the accompanying drawings, in which:

FIG. 1 is a schematic side sectional elevation of a first embodiment of the apparatus of the present invention, FIG. 2 is an enlarged schematic side sectional elevation of the part of the apparatus of FIG. 1 in the region of the spray nozzle for the feed liquid, and FIG. 3 is a schematic side sectional elevation of a second embodiment of the present invention.

Referring to FIG. 1, the apparatus of the first embodiment comprises a hollow upper cylindrical vessel (1) mounted with its long axis vertical and connected at its open lower end by a throat of reduced diameter (2) to a vertically disposed hollow lower cylindrical vessel (3). A duct (4) entering the lower vessel (3) obliquely feeds a drying gas upwardly into approximately the mid-point of lower vessel (3). An upwardly directed spray nozzle (5) also known generically as an atomizer (5), fed by a side entry liquid feed pipe (6) is arranged to lie along the common vertical axis of the upper and lower vessels (1) and (3), with its spray tip disposed in the upper half of the throat (2). Both the upper and lower vessels (1) and (3) taper towards the throat (2) relatively (such that the lower portion of the drying vessel 1 is frusto-conical and tapers downwardly and inwardly) rapidly whilst the angle of spray of the nozzle (5) is relatively narrow so that the liquid droplets which are sprayed by the nozzle (5) axially up into the upper cylindrical vessel (l) would, if they were able to, strike the side walls of the upper vessel (1) in its upper half.

In the upper vessel (1) the liquid droplets from the nozzle (5) are dried by the drying gas, and the drying gas is thereby cooled. The drying gas is arranged to flow through the throat (2) in substantially parallel flow, and leaving a slower moving boundary layer adjacent the walls of the throat (2) as will be explained in greater detail below. A side entry duct (7) arranged towards the closed upper end of the vessel (2) carries the cooled gas and the dried particles to a primary separation cyclone (8). Gas and fine particles pass via duct (9) from the primary cyclone (8) to a secondary cyclone (10) which removes essentially all of the remaining solid particles. Cleaned gas flows out of the secondary cyclone (10) through duct (11) to an exhaust fan (12) which draws the drying gas through the apparatus and discharges it to the atmosphere or a solvent recovery system (not shown) via duct (13).

A fractionating device (14) arranged beneath the primary separator (8) divides the heavy solid product leaving the bottom of the primary separator (8) into a first optional product stream (15) and a solids recycle stream (16) which passes back solids to the upper vessel (1) via a solids conveyor (17). A similar fractionating device (18) arranged beneath the secondary separator (10) divides the heavy solid product leaving the bottom of separator (10) into a second optional product stream (19) and a solids recycle stream (20) which passes back solids to the upper vessel (1) via the solids conveyor (17). The solids conveyor (17) is arranged to feed the recycled solids stream into the upper vessel (1) at the point at which its side walls start to taper inwardly towards the throat (2). Dried solid product of the desired particle size falls down from the upper vessel (1) past the spray nozzle (5) into the bottom of the lower vessel (3) where it is collected and removed from the apparatus via conveyor (21).

In the course of operating the apparatus, it was found that, because of the rapid reduction in the velocity of the drying gas as it exited the throat (2) and entered the upper vessel (1), a boundary layer separation took place within the lower part of the vessel (1) which produced extremely intimate mixing of the gas and the liquid droplets being dried, as is described in DK-A-5888/83.

The apparatus may be of simple metallic or plastics construction, or may be refractory lined with refractory lining material, if the temperatures so require in order to heat treat the solid materials.

The broad and preferred range of the determining parameters of the throat area of the apparatus of the present invention illustrated in FIG. 1 are set out in Table I below which refers to the legends shown in FIG. 2.

TABLE I

| | BROAD | PREFERRED |
|---|---|---|
| 1) α, Internal Core Angle of Spray | 5–50° | 10–20° |
| 2) β, Discharge Angle of Throat | 0–75° | 30–60° |
| 3) δ, Entry Angle of Throat | 0–75° | 30–60° |
| 4) $L/D_1$, Ratio of Length to Diameter of Upper Vessel (1) | 2–20 | 5–15 |
| 5) $D_2/D_1$, Ratio of Throat to Vessel (1) Diameter | 0.1–0.9 | 0.3–0.7 |
| 6) $D_2/D_1$, Ratio of Diameter of Vessels (1) & (3) | 0.1–1.0 | 0.3–1.0 |
| 7) $l/D_2$, Ratio of Throat Length to Throat Diameter | 0.25–10 | 0.5–2.0 |
| 8) $h/D_2$, Nozzle Submergence Ratio | 0 +/− 1.0 | 0 +/− 0.5 |
| 9) Throat Gas Velocity | 2–50 m/s | 10–30 m/s |
| 10) Upper Vessel (1) Gas Velocity | 1–20 m/s | 3–10 m/s |
| 11) Product Particle Size | 0.5–10 mm | 1–5 mm |

A wide variety of materials can be dried using the apparatus of the present invention. One particular example tested was a mixture of ground bauxite, Bayer spent liquor, and waste sodium salts separated from Bayer liquor by evaporative crystallisation, using hot air as the drying medium. The initial material contained about 50% by weight moisture, and was a free flowing aqueous slurry. It was found to pass through an intensely sticky phase as it dried, and so this type of mixture is normally treated by back mixing with some of the dried product (see, for example U.S. Pat. No. 4,280,987).

Surprisingly, it was found that after a short period of drying of the mixture using the apparatus of the present invention a dried agglomerated product of uniform particle size was discharged continuously from the bottom of lower vessel (3), via conveyor (21). This was unexpected, because the free-fall settling velocity of the particles of the dried product was lower than the high velocity of hot air passing through the throat (2) of the apparatus. The dried product was also found to be non-dusting, coarse, uniform, spherical and strong.

It has further been found that the particle size of the dried product can be controlled by the degree of atomization of the feed slurry, the gas velocity in the throat, and the geometry of the throat area. In spite of the sticky nature of the feed material, there was found to be no encrustation of the apparatus during its operation.

If required, dried product may be withdrawn from the apparatus in three size fractions, from 15, 19 and 21, Alternatively, all of the dried product may be recovered at 21, if so desired.

In a further development of the present invention, it has been found that if core material, i.e. the material to be coated, is fed to the apparatus via conveyor (17), the apparatus will operate as a coating system laying down an even coating of the material fed through nozzle (5) over the core material.

It is postulated that the success of the present invention lies in the setting up of an internal circulation of dried material which prevents coating and scaling of the walls of the upper vessel (1), and which provides a core material on which fresh feed material will deposit to form successive layers of hard dried product. The discharge of dried material passed the spray nozzle and through the throat is believed to be permitted because an annular effect caused by the velocity profile in the throat. The fast moving drying gas moving through the narrow throat (2) is believed to create near the walls of the throat a relatively slow moving boundary layer through which descending dried product can fall counter-currently to the upwardly moving drying gas. By this means the dried product particles are not entrained in the gas flow.

If desired, a multiplicity of throats and nozzles may be incorporated into a single large upper vessel (1) to achieve high production rates of dried material.

EXAMPLES

Five test runs were performed using as the feed liquid an aqueous slurry of bauxite for Runs 1 and 2 and an aqueous slurry of Bayer process salt cake for Runs 3, 4 and 5. The apparatus used for these test runs was a variation of the first embodiment illustrated in FIGS. 1 and 2, and this is shown in FIG. 3 where the elements which correspond to those illustrated in FIG. 1 are referred to by the same numbers but increased by 100. In the second embodiment of the present invention illustrated in FIG. 3, the duct (104) for the drying gas does not enter a lower vessel but leads directly to throat (102), the internal diameter of the duct (104) being slightly greater than that of the throat (102). In order to collect the dried particles which descend through the throat (102) a right angle bend is provided in the duct (104), and immediately upstream of this bend is provided the opening for the solids conveyor (121).

In order to maintain substantially laminar flow along the duct (104) around its bend, curved guide vanes (122) are provided within the duct (104) at its apex.

The drying vessel (101) was 10 meters high by 1 meter in diameter and was fed with drying air from a 2MW oil fired heater. Slurry feed during the period of highest production during the five runs was 627 1/h which corresponds to 393 kg of dry material per hour. On average recycling of the dried material amounted to between 2.5 and 4.5 times the weight of dried material produced.

The results for these five runs are shown in Table II below, from which it will be noted that it was only in Run 3 that some encrustation of the equipment was encountered, but this was due to uneven air flow to the spray nozzle which resulted in irregular atomization of the slurry. On average the amount of atomization air fed to the spray nozzle (105) was approximately 9% of the weight of the slurry fed to the nozzle.

TABLE II

| FEED | BAUXITE SLURRY | | SALT CAKE SLURRY | | |
|---|---|---|---|---|---|
| RUNS | 1 | 2 | 3 | 4 | 5 |
| Operating Conditions | | | | | |
| Inlet Temp. (° C.) | 298 | 348 | 390 | 406 | 404 |
| Outlet Temp. (° C.) | 226 | 238 | 266 | 248 | 221 |
| Inlet Pressure (kPa) | 1.46 | 0.86 | 0.62 | 0.52 | 0.52 |
| Outlet Pressure (kPa) | 1.55 | 0.91 | 0.68 | 0.68 | 0.91 |
| Gas Flow (kg/s) | 2.4 | 2.4–2.2 | 1.8 | 1.8 | 1.8 |
| Production | | | | | |
| Agglomerated Solids (kg) | 196 | 317 | 891 | 954 | 524 |
| Coating on Walls (kg) | — | — | 78 | — | — |
| Fine Dust (kg) | 40 | 30 | 103 | 186 | 105 |
| Material in Process (kg) | 592 | 269 | 373 | 348 | 84 |
| % Product (by weight) | 23 | 52 | 62 | 64 | 74 |

Size analyses were performed on the material produced as product and as recycling material during Runs 4 and 5, and these are set out in Table III below.

TABLE III

| Size Analyses: | | | | |
|---|---|---|---|---|
| Agglomerated material: | | Recycling material: | | |
| | | Run | 4 | 5 |
| mm | % | mm | % | % |
| +8 | 0 | +1000 | 1.7 | 5 |
| +4 | 1 to 40 | +500 | 11 | 24 |
| +2 | 34 to 91 | +250 | 31 | 52 |
| | | +125 | 56 | 74 |
| | | +45 | 86 | 92 |

We claim:

1. An apparatus for continuously drying solid material borne in a liquid, which apparatus comprises a drying vessel having a lower inlet for a drying gas and an upper outlet for a mixture of the drying gas and entrained dried particles of solid material, an upwardly directed spray nozzle for the liquid bearing solid material, and an outlet for the dried particles, wherein a lower portion of the drying vessel is shaped to guide descending particles of the solid material being dried by the drying gas back towards the drying gas inlet, characterised in that the spray nozzle is positioned within the lower inlet for the drying gas but spaced from the walls thereof, and in that the apparatus further includes means for separating the entrained dried particles from their mixture with the drying gas, means for returning the separated dried particles to the drying vessel, and means for continuously removing she dried particles positioned with the outlet below the spray nozzle, and in that the drying gas inlet is arranged to supply the drying gas into the drying vessel past the spray nozzle in substantially parallel flow leaving a slower moving boundary layer adjacent the walls of the drying gas inlet through which dried particles can fall under gravity towards the outlet, when the apparatus is in use.

2. An apparatus as claimed in claim 1 including a single drying gas inlet, wherein the interior of the lower portion of the drying vessel is frusto-conical and tapers downwardly and inwardly towards the single drying gas inlet.

3. An apparatus as claimed in claim 1, wherein the drying gas inlet includes an angled duct upstream from and in proximity to the outlet.

4. An apparatus as claimed in claim 3 including an inlet gas guide means in proximity to the angled duct for assisting the maintenance of substantially parallel flow of the drying gas around the angled duct, when the apparatus is in use.

5. An apparatus as claimed in claim 1, wherein the drying gas inlet is in the form of a straight duct connecting the drying vessel to a dried particles collecting vessel having therein an inlet for the drying gas and an outlet for the dried particles.

6. An apparatus as claimed in claim 5, wherein the upper portion of the collecting vessel is frusto-conical and tapers upwardly and inwardly towards the said straight duct.

7. An apparatus as claimed in claim 1 and having a range of measurement parameters wherein an internal core angle of spray is 5–50°, a discharge angle of a throat connecting the drying vessel and a dried particles collecting vessel is 0–75°, an entry angle of the throat is 0–75°, a ratio of length to diameter of the drying vessel is 2–20, a ratio of throat diameter to drying vessel diameter is 0.1–0.9, a ratio of throat length to the throat diameter is 0.25–2.0, and a submergence ratio of the spray nozzle is 0 plus or minus 1.0.

8. An apparatus as claimed in claim 1 and having a range of measurement parameters wherein an internal core angle of spray is 10–20°, a discharge angle of a throat connecting the driving vessel and a dried particles collecting vessel is 30–60°, an entry angle of the throat is 30–60°, a ratio of length to diameter of the drying vessel is 5–15, a ratio of throat diameter to drying vessel diameter is 0.3–0.7, a ratio of throat length to the throat diameter is 0.5–1.0, and a submergence ratio of the spray nozzle is 0 plus or minus 0.5.

9. An apparatus as claimed in claim 1 and including at least one separated particle classification means for selecting particles of a defined particle size for return to the drying vessel.

10. An apparatus as claimed in claim 1, when adapted to act as an agglomerating apparatus, including means for supplying a core material towards the drying gas inlet.

11. An apparatus as claimed in claim 1, further including refractory lining material to adapt the apparatus to heat treat the solid particles.

12. A method of continuously drying solid material borne in a liquid which method comprises:

spraying a liquid bearing solid material upwardly into a drying zone, feeding a drying gas into the drying zone from below the spraying liquid in substantially parallel flow, removing the mixture of the drying gas and entrained dried particles from the drying zone, separating the entrained dried particles from their mixture with the drying gas, returning the separated dried particles to the drying zone, and collecting the dried particles continuously from below the spraying liquid, wherein a slower moving boundary layer is arranged to be formed within the feeding of the drying gas, through which boundary layer dried particles are allowed to fall under gravity to be collected.

13. A method as claimed in claim 12, wherein a circulation of drying particles is set up within the drying zone, the descending drying particles being guided towards the feeding drying gas.

14. A method as claimed in claim 12 including classifying the separated dried particles and returning to the drying zone only those of a selected particle size.

15. A method as claimed in claim 12, wherein the liquid is a slurry of bauxite.

16. A method as claimed in claim 12, wherein dry particles are produced which have an average particle size of from 2 to 15 mm.

17. A method as claimed in claim 12, wherein the temperature reached by the drying particles in the drying vessel is sufficiently high to effect chemical reaction of the particles.

18. A method of continuously drying and size-classifying solid material borne in a liquid which method comprises the steps of:

converting a feed liquid bearing solid material into an aerosol mist of finely divided droplets by passing it through an atomizer located axially in an inlet gas throat below the bottom frusto-conical section of a drying vessel;

concurrently passing through the throat a flow of gas heated to between 100 and 1000° C. in substantially parallel flow;

subjecting the combined streams of gas and aerosol to a rapid reduction in velocity by passing them into a drying vessel mounted on top of the frusto-conical section, so as to cause a boundary separation in the bottom part of the vessel;

accumulating a layer of particles above the throat of the vessel;

passing the resulting dispersion of gas and fine particles at the top of the vessel through one or a plurality of solid/gas separators to separate the solid residue from the gas;

venting the gas to the atmosphere or recycling the gas to the process;

returning the fine particles to the bottom of the vessel;

passing the particles from the accumulated layer through the throat of the vessel counter-current to the upward flow of hot gas;

collecting the size-classified product in the gas supply duct located below the throat of the atomizer; and removing the dried and size-classified particles continuously from the gas supply duct.

19. A method as claimed in claim 18, wherein the liquid is a slurry of bauxite.

20. A method as claimed in claim 18, wherein dry particles are produced which have an average particle size of from 2 to 15 mm.

21. A method as claimed in claim 18, wherein the temperature reached by the drying particles in the drying vessel is sufficiently high to effect chemical reaction of the particles.

22. A method as claimed in claim 18 further comprising:

passing the flow of gas trough a bend in its supply duct, preferably a right angled bend filled with curved flow straightening vanes, prior to passing tie flow of gas into the throat.

23. A method of continuously drying, size-classifying and coating dry particles, which method comprises the steps of:

converting a feed solution of binder for the coating, which includes a coating material dissolved in a suitable liquid carrier or solvent, into an aerosol mist by passing it through an atomizer located axially in an inlet gas throat below the bottom frusto-conical section of a drying vessel;

concurrently passing through the throat a flow of gas heated to between 100 and 1000° C. in substantially parallel flow;

subjecting the combined streams of gas and aerosol to a rapid reduction in velocity by passing them into a drying vessel mounted on top of the frusto-conical section, so as to cause a boundary separation in the bottom part of the vessel;

simultaneously introducing the particles to be treated into the bottom of the vessel just above the frusto-conical section;

passing the dispersion of gas and fine particles at the top of the vessel through at least one solid-gas separator to separate the solid residue from the gas;

venting the gas to the atmosphere or recycling it to the process;

returning the fine particles to the bottom of the vessel;

accumulating a layer of particles above the throat of the vessel;

passing the particles through the throat of the vessel counter-current to the upward flow of hot gas;

collecting the size-classified product in the gas supply duct located below the throat of the atomizer; and removing the dried, size-classified, and coated particles continuously from the gas supply duct.

24. A method as claimed in claim 23, wherein the liquid is a slurry of bauxite.

25. A method as claimed in claim 23, wherein dry particles are produced which have an average particle size of from 2 to 15 mm.

26. A method as claimed in claim 23, wherein the temperature reached by the drying particles in the drying vessel is sufficiently high to effect chemical reaction of the particles.

27. A method as claimed in claim 23 further comprising:

passing the flow of gas through a bend in its supply duct, preferably a right angled bend fitted with curved flow straightening vanes, prior to passing the flow of gas into the throat.

28. A method as claimed in claim 23 further comprising:

are agglomerating as well as coating the dry particles.

* * * * *

UNITED STATES PATENT AND TRADEMARK OFFICE

CERTIFICATE OF CORRECTION

PATENT NO : 5,946,818

DATED : September 7, 1999

INVENTOR(S) : Hamish Baxter, Andrew Nicolson Caruthers, Hans-Peter Elkjaer, Bryan Hiscox, Jens Fenger, Benny E. Raahauge, and Jose Gil Fernandez-Pulpeiro It is certified that error appears in the above-identified patent and that said Letters Patent are hereby corrected as shown below:

Abstract, line 9, "The" should read --the--; line 17, "lo" should read --to--.

Column 2, line 61, "Who" should read --who--.

Column 3, line 42, "infecting" should read --injecting--.

Column 5, line 52, "trying" should read --drying--; line 65, "massing" should read --passing--.

Column 11, line 5, "she" should read --the--; line 43, "driving" should read --drying--.

Claim 22, line 2, "trough" should read --through--; line 3, "filled" should read --fitted-- and "tie" should read --the--.

Signed and Sealed this

Twenty-ninth Day of May, 2001

Nicholas P. Godici

*Attest:*

NICHOLAS P. GODICI

*Attesting Officer*

*Acting Director of the United States Patent and Trademark Office*